US009790888B2

(12) United States Patent
Wicks

(10) Patent No.: US 9,790,888 B2
(45) Date of Patent: Oct. 17, 2017

(54) INTERNAL COMBUSTION ENGINE

(71) Applicant: Ford Global Technologies, LLC, Dearborn, MI (US)

(72) Inventor: Christopher Donald Wicks, Allen Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 164 days.

(21) Appl. No.: 14/954,061

(22) Filed: Nov. 30, 2015

(65) Prior Publication Data

US 2017/0152810 A1 Jun. 1, 2017

(51) Int. Cl.

| | |
|---|---|
| ***F02B 75/18*** | (2006.01) |
| ***F02F 1/14*** | (2006.01) |
| ***F02F 1/40*** | (2006.01) |
| ***F02F 11/00*** | (2006.01) |

(52) U.S. Cl.

CPC ..... *F02F 1/14* (2013.01); *F02F 1/40* (2013.01); *F02F 11/002* (2013.01); *F02F 2200/06* (2013.01)

(58) Field of Classification Search

CPC ..... F02F 1/24; F02F 7/0002; F02F 7/0021; F02F 7/0024; F02F 2001/104; F02F 2001/008; F02F 1/14; F02F 11/002; F02F 1/40; F02F 2200/06; F01P 3/02; F01P 2003/024

See application file for complete search history.

(56) References Cited

U.S. PATENT DOCUMENTS

| | | | | |
|---|---|---|---|---|
| 3,410,256 | A * | 11/1968 | Herschmann | F01P 3/02 123/193.3 |
| 3,534,715 | A * | 10/1970 | Foreman | F01B 7/14 123/41.79 |
| 3,765,385 | A * | 10/1973 | Conrad | F01P 3/02 123/193.3 |
| 3,769,948 | A * | 11/1973 | Feichtinger | F02F 1/4214 123/188.14 |
| 4,917,169 | A * | 4/1990 | Melde-Tuczai | B22C 9/10 164/369 |
| 5,474,040 | A | 12/1995 | Murakami et al. | |
| 5,873,163 | A * | 2/1999 | Diefenthaler | B23P 6/02 29/888.011 |
| 6,138,619 | A * | 10/2000 | Etemad | F02F 1/14 123/41.74 |
| 6,555,241 | B1 | 4/2003 | Erbsloh et al. | |

(Continued)

FOREIGN PATENT DOCUMENTS

| | | | |
|---|---|---|---|
| JP | H11294254 | A | 10/1999 |
| JP | 4591482 | B2 | 12/2010 |

*Primary Examiner* — Hung Q Nguyen

(74) *Attorney, Agent, or Firm* — Brooks Kushman P.C.; Greg Brown

(57) ABSTRACT

An engine has a cylinder block with first and second cylinders separated by a bore bridge. The block has a cooling jacket with a cooling channel intersecting a block deck face and circumferentially surrounding the first and second cylinders such that the engine block has an open deck configuration. The engine has a cylinder head with a surface configured to mate with the deck face of the block. The surface of the head has a sleeve protruding therefrom. The sleeve is sized to be received by the channel to circumferentially surround the first and second cylinders to structurally support the cylinders.

20 Claims, 6 Drawing Sheets

(56) References Cited

U.S. PATENT DOCUMENTS

| | | | | |
|---|---|---|---|---|
| 7,047,915 | B2 | 5/2006 | Kawai et al. | |
| 7,255,069 | B2 | 8/2007 | Liebert | |
| 7,513,237 | B1 | 4/2009 | Liebert | |
| 7,798,108 | B2 | 9/2010 | Konishi et al. | |
| 8,844,478 | B2 | 9/2014 | Roth | |
| 8,919,302 | B2 | 12/2014 | Hamakawa et al. | |
| 9,086,031 | B2 | 7/2015 | Williams et al. | |
| 2005/0235930 | A1* | 10/2005 | Xin | F02F 1/14 123/41.74 |
| 2005/0268868 | A1* | 12/2005 | Kawai | F01P 3/02 123/41.31 |
| 2006/0102110 | A1* | 5/2006 | Takenaka | F02F 7/0021 123/41.82 A |
| 2012/0132157 | A1* | 5/2012 | Matsuki | F02F 1/14 123/41.79 |
| 2015/0101551 | A1 | 4/2015 | Kawasaki et al. | |
| 2015/0247472 | A1 | 9/2015 | Nomura | |

* cited by examiner

INTERNAL COMBUSTION ENGINE

TECHNICAL FIELD

Various embodiments relate to an internal combustion engine with a crankcase or a cylinder block having an open deck configuration.

BACKGROUND

Internal combustion engines have a crankcase or a cylinder block that cooperates with a cylinder head to form combustion chambers for the engine. Conventional engines are often provided with a flush cylinder head deck face and a flush cylinder block deck face that form mating surfaces and cooperate with a head gasket for sealing the engine.

SUMMARY

An engine is provided with a cylinder block having first and second cylinders separated by a bore bridge. The block has a block cooling jacket with a channel intersecting a block deck face to circumferentially surround the first and second cylinders. A cylinder head has a surface configured to mate with the deck face of the block. The surface of the head has a sleeve protruding therefrom. The sleeve is sized to be received by the channel to circumferentially surround the first and second cylinders.

An engine is also provided with a cylinder block defining a cooling channel circumferentially surrounding an outer wall of at least one cylinder. The cooling channel intersects a deck face. A cylinder head has a surface configured to mate with the deck face, and the surface has at least one projection extending outwardly therefrom. The projection is received by the channel to cooperate with the outer wall and structurally support at least one cylinder.

A method of forming an engine is provided. A block is formed with cast-in passages for a cooling jacket and with first and second adjoined cylinders having an outer wall. The cooling jacket circumferentially surrounds the outer wall and intersects a block deck face. A cylinder head is formed with at least one projection extending outwardly from an intermediate region of a head deck face. The head deck face is configured to cooperate with the block deck face. The cylinder head and the block are assembled such that at least one projection is received within the cooling jacket to surround and cooperate with the outer wall of the first and second cylinders to structurally support the first and second cylinders.

Various embodiments according to the present disclosure have associated non-limiting advantages. For example, the engine block and head may be die cast while retaining strength properties that were previously available only using a sand casting technique. As engine package sizes become smaller for weight reduction, and the increasing demand and requirements for increased fuel economy and reduced emissions continues, engines may be operated at higher operating pressures. In some examples, with a turbocharged or super charged engine, the engine may also operate at increased boost pressures compared to previously turbocharged engines. The interlocking structure of the head and the upper regions of the cylinders provides for structural support as the cylinders are nested and radially supported by the sleeve projecting from the head deck face. As the engine may be provided in an open deck configuration, e.g. as provided from a die cast component, the sleeve projection from the head acts to structurally support the otherwise unsupported upper region of the cylinders, reduce cylinder and interbore distortion at high operating temperatures, and prevent or reduce cylinder shake, movement, or vibration, for example, at high engine load and output.

DETAILED DESCRIPTION

As required, detailed embodiments are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
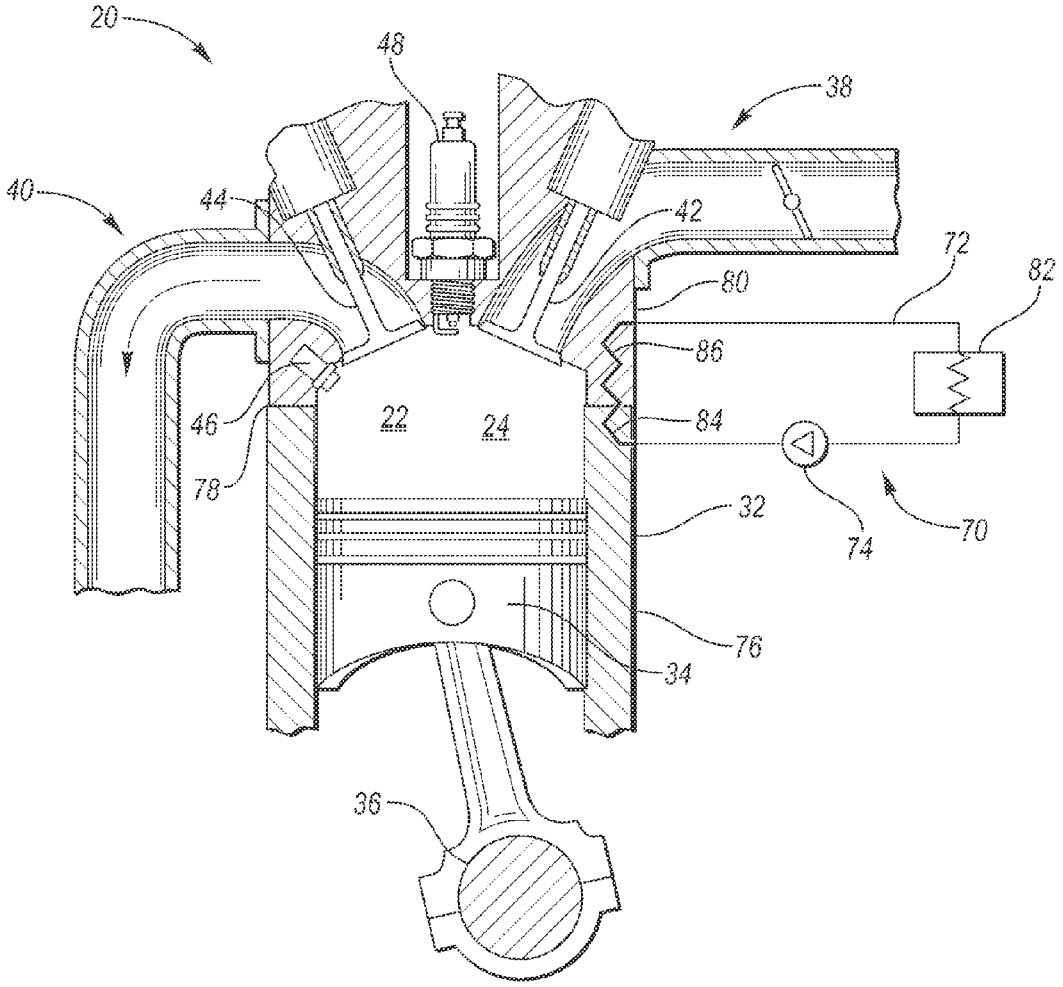
FIG. 1 illustrates a schematic of an internal combustion engine configured to implement the disclosed embodiments.

FIG. 1 illustrates a schematic of an internal combustion engine 20. The engine 20 has a plurality of cylinders 22, and one cylinder is illustrated. The engine 20 has a combustion chamber 24 associated with each cylinder 22. The cylinder 22 is formed by cylinder bore walls 32 and piston 34. The piston 34 is connected to a crankshaft 36. The combustion chamber 24 is in communication with the intake manifold 38 and the exhaust manifold 40. An intake valve 42 controls flow from the intake manifold 38 into the combustion chamber 24. An exhaust valve 44 controls flow from the combustion chamber 24 to the exhaust manifold 40. The intake and exhaust valves 42, 44 may be operated in various ways as is known in the art to control the engine operation.

A fuel injector 46 delivers fuel from a fuel system directly into the combustion chamber 24 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 24. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP) sensor, an crankshaft position sensor for crankshaft position, an mass air flow sensor in the air duct 38, a throttle position sensor, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. During the intake stroke, fuel is introduced and the intake valve 42 opens and the exhaust valve 44 closes while the piston 34 moves from the top of the cylinder 22 to the bottom of the cylinder 22 to introduce air from the intake manifold to the combustion chamber 24. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

With the fuel air charge compressed within the combustion chamber 24 the atomized air charge is ignited with spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion chamber 24 to the exhaust manifold 40 and to an after treatment system such as a catalytic converter.

The intake and exhaust valve 42, 44 positions and timing, as well as the fuel injection timing and ignition timing may be varied as part of the engine control strategy.

The engine 20 may include a turbocharger, supercharger, or other forced induction device to increase the pressure of the intake gases and increase engine power output.

The engine 20 includes a cooling system 70 to remove heat from the engine 20. The amount of heat removed from the engine 20 may be controlled by a cooling system controller or the engine controller. The cooling system 70 may be integrated into the engine 20 as a cooling jacket. The cooling system 70 has one or more cooling circuits 72 that may contain an ethylene glycol/water antifreeze mixture or another coolant as the working fluid. In one example, the cooling circuit 72 has a first cooling jacket 84 in the cylinder block 76 and a second cooling jacket 86 in the cylinder head 80 with the jackets 84, 86 in fluid communication with each other. The block 76 and the head 80 may have additional cooling jackets. Coolant, such as antifreeze, in the cooling circuit 72 and jackets 84, 86 flows from an area of high pressure towards an area of lower pressure.

The cooling system 70 has one or more pumps 74 that provide fluid in the circuit 72 to cooling passages in the cylinder block 76. The cooling system 70 may also include valves (not shown) to control to flow or pressure of coolant, or direct coolant within the system 70. The cooling passages in the cylinder block 76 may be adjacent to one or more of the combustion chambers 24 and cylinders 22, and the bore bridges formed between the cylinders 22. Similarly, the cooling passages in the cylinder head 80 may be adjacent to one or more of the combustion chambers 24 and cylinders 22, and the bore bridges formed between adjacent combustion chambers 24. The cylinder head 80 is connected to the cylinder block 76 to form the cylinders 22 and combustion chambers 24. At least one sealing member 78, such as a head gasket, is interposed between the cylinder block 76 and the cylinder head 80 to seal the cylinders 22. The sealing member 78 may also have a slot, apertures, or the like to fluidly connect the jackets 84, 86, and selectively connect passages between the jackets 84, 86. Coolant flows from the cylinder head 80 and out of the engine 20 to a radiator 82 or other heat exchanger where heat is transferred from the coolant to the environment.

Figure 2:
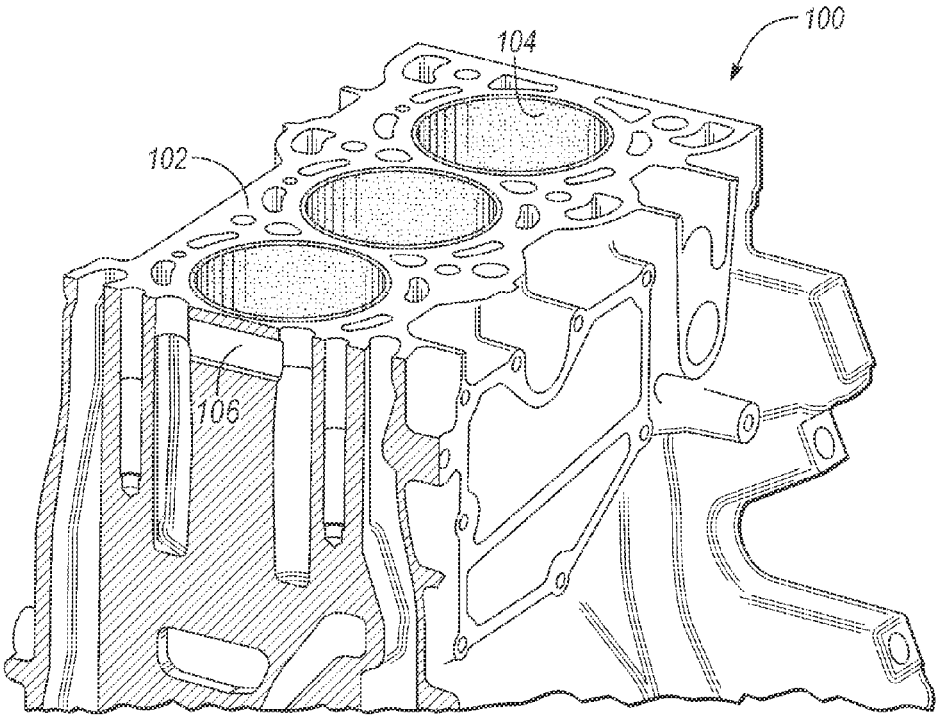
FIG. 2 (Prior Art)
FIG. 2 illustrates a perspective schematic view of a conventional engine block with a closed or semi closed block deck face and an internal interbore cooling passage.

A conventional cylinder block 100 in an engine may be formed with a closed or semi closed deck 102, an example of which is shown in FIG. 2. The engine block may be cast, for example, using a sand casting process. The block has cylinder liners 104 formed from iron or another ferrous alloy, with the cast metal surrounding the liners. In one example, the cast metal is aluminum or an aluminum alloy. The cylinders may be aligned in an in-line configuration, with an interbore region or bore bridge between adjacent cylinders. An interbore cooling passage 106 may be cast into the block in the bore bridge region as an internal cooling passage.

Figure 3:
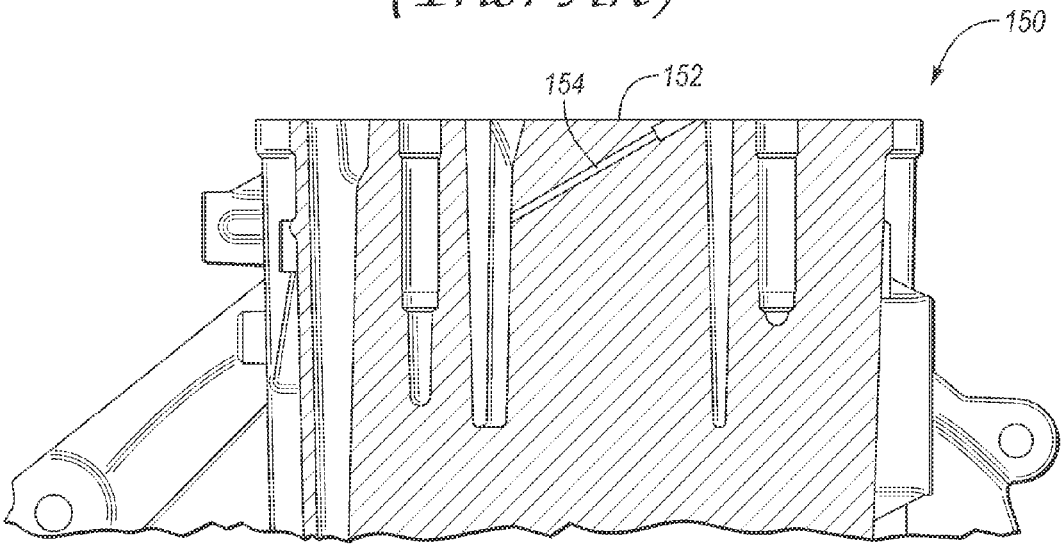
FIG. 3 (Prior Art)
FIG. 3 illustrates a partial sectional schematic view another conventional engine block with a semi closed block deck face and an internal interbore cooling passage.

Another conventional cylinder block 150 in an engine may be formed with an open deck or a semi-open deck, an example of which is shown in FIG. 3. The engine block may be cast, for example, using a die casting process. The block has cylinder liners (not shown) formed form iron or another ferrous alloy, with the cast metal surrounding the liners. In one example, the cast metal is aluminum or an aluminum alloy. The cylinders may be aligned in an in-line configuration, with an interbore region or bore bridge between adjacent cylinders. An interbore cooling passage may be formed, e.g. machined, into the block deck face in the bore bridge region as a cooling passage, for example, as an open channel or saw cut across the bore bridge, or as a drilled passage 154 provided across the bore bridge and at a nonparallel angle relative to the deck face 152.

In both of these conventional cylinder blocks, the cylinder liners provide for structural support of the block, particularly in the interbore region, as the dimensions may be small and on the order of millimeters. The cylinder block additionally provides support structure by at least partially surrounding the liners, as shown in 2, and by providing interbore support structure as shown in FIG. 3.

Figure 4:
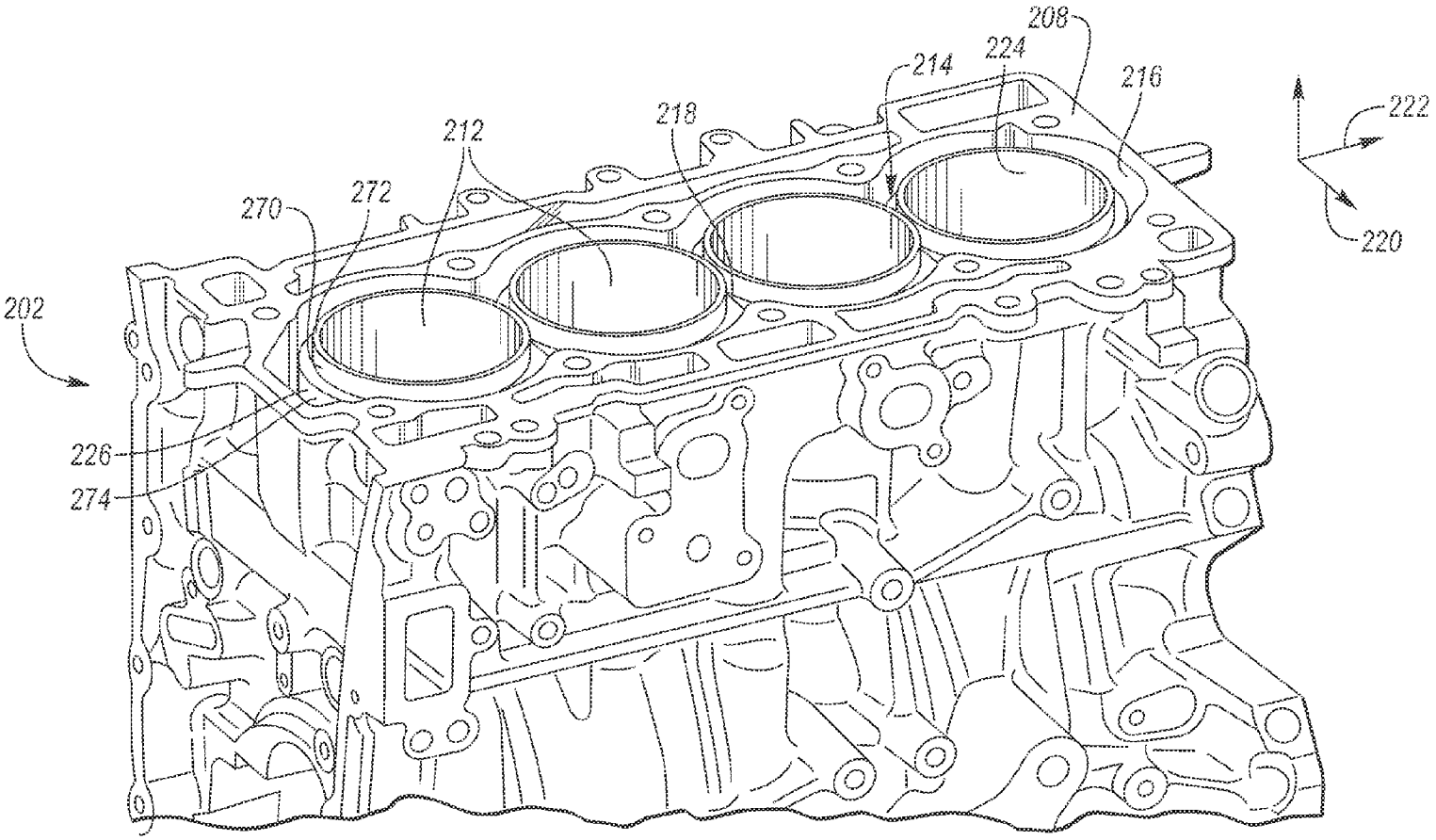
FIG. 4 illustrates an perspective view of an engine block for use with an engine according to an embodiment.
Figure 5:
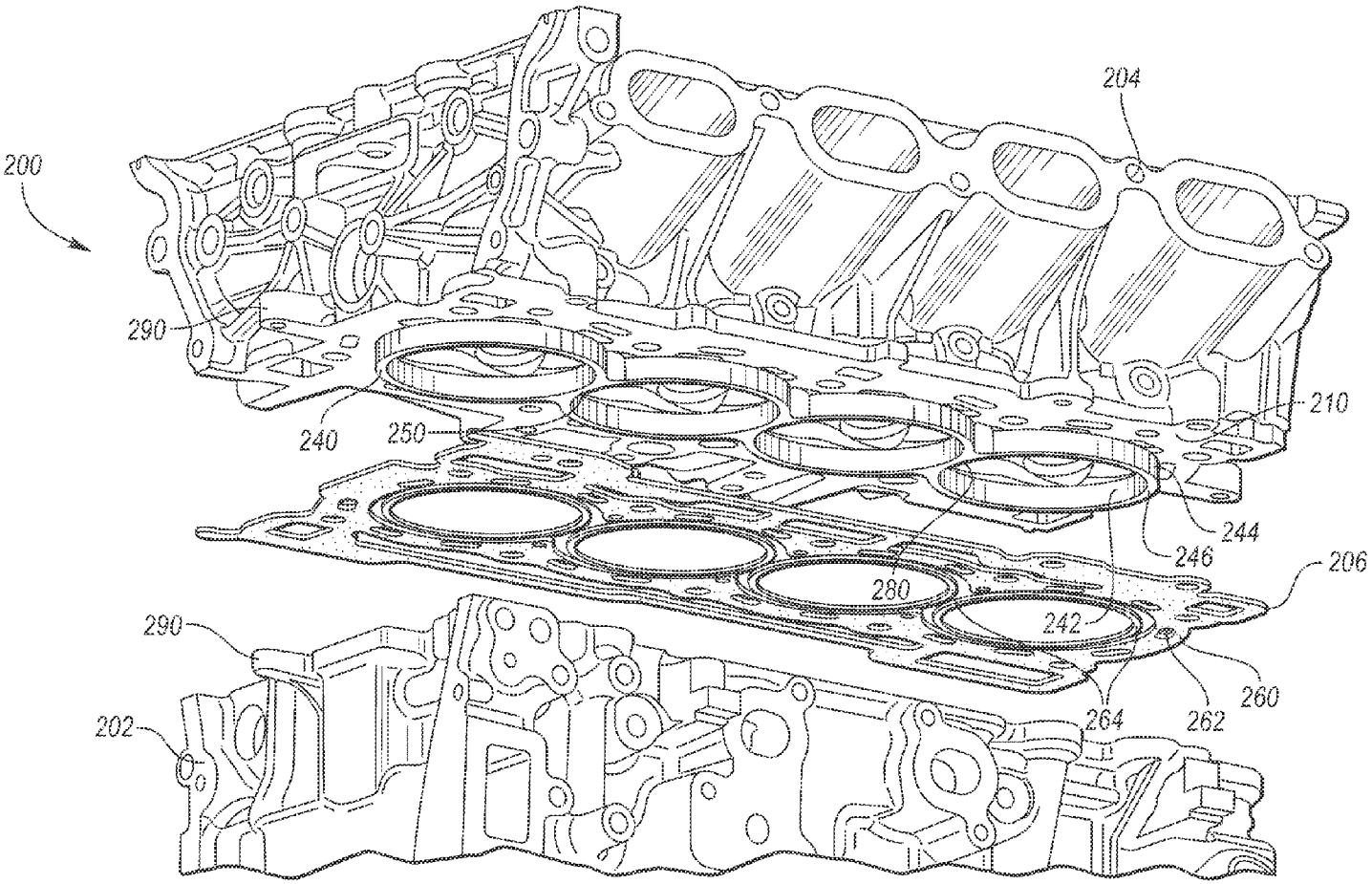
FIG. 5 illustrates a perspective view of a cylinder head and a sealing member for use with the engine block of FIG. 4.
Figure 6:
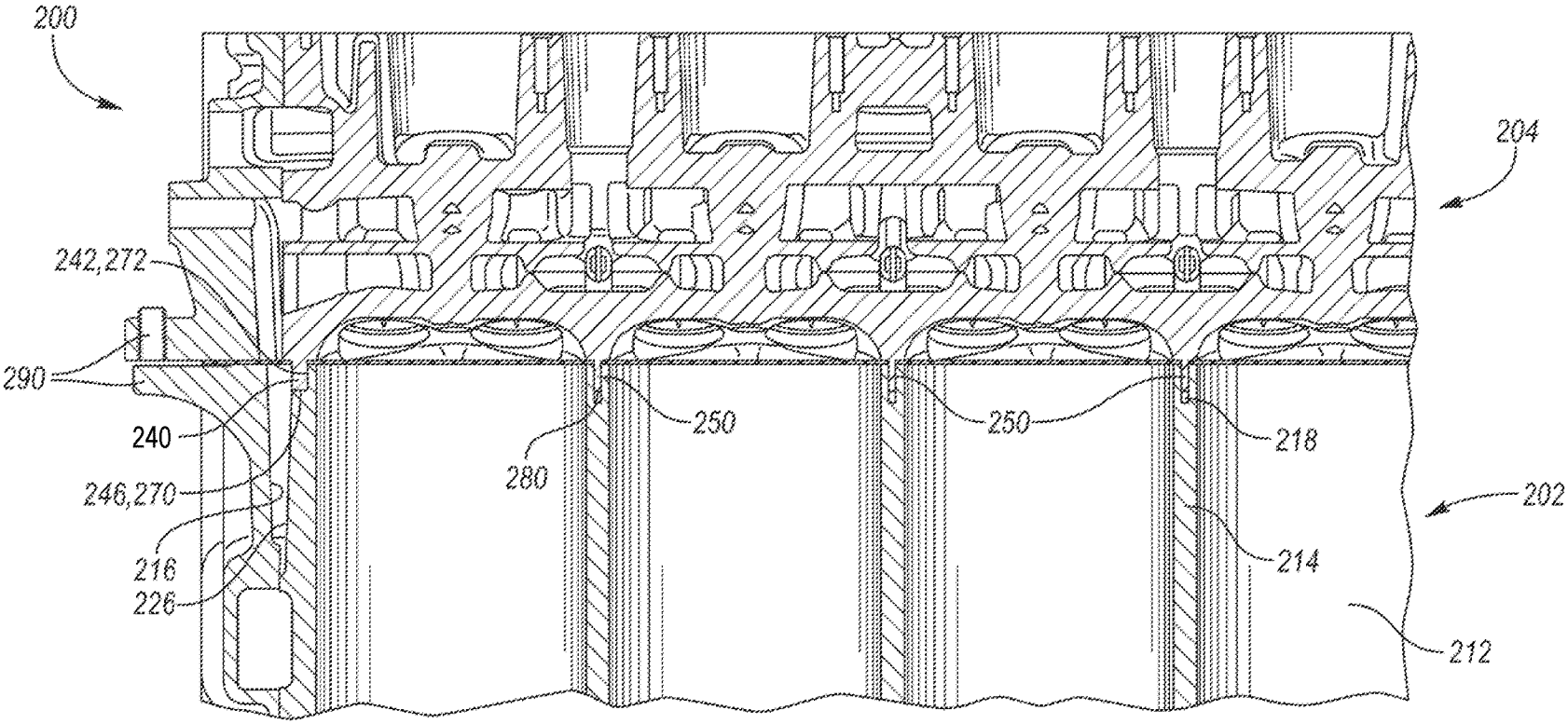
FIG. 6 illustrates a partial sectional view of the engine of FIGS. 4 and 5.

FIGS. 4-6 illustrate an engine 200 as an example of the present disclosure. FIG. 4 illustrates a perspective view of a cylinder block 202 or crankcase for use with the engine 200. FIG. 5 illustrates an exploded view of the engine 200 according to an embodiment. FIG. 6 illustrates a partial sectional view of the engine 200. Although the engine 200 is illustrated as an in-line, four cylinder engine, use of the disclosure with engines of other configurations is also contemplated.

The engine 200 may be the engine 20 as described above. The cylinder block 202 of the engine is connected to the cylinder head 204 using sealing member 206 to form and seal at least one combustion chamber in the engine. The sealing member 206 may include a head gasket and may additionally include other sealing components. The deck face 208 of the cylinder block 202 and the deck face 210 of the cylinder head 204 are in contact with first and second opposed sides of the sealing member 206.

As shown in FIG. 4, the cylinder block 202 has at least two cylinders or bores 212, and the engine 200 is illustrated as an in-line four cylinder 212 engine. Between adjacent cylinders or bores 212 in the block 202 are bore bridges 214, or interbore regions.

Coolant flows into the engine 200, and may flow into a cooling jacket 216 surrounding the cylinders 212. The cooling jacket 216 may be a continuous channel surrounding a periphery, or circumferentially surrounding, the outer walls of the cylinders 212. As shown, the open channel of the cooling jacket 216 may intersect the deck face 208 of the block. The engine block 202 is illustrated as having an open or semi-open deck configuration. Coolant flows from the block cooling jacket 216, through various apertures, and may flow into one or more cooling jackets formed in the head 204.

The cylinders 212 are illustrated as being adjoined, for example, in a siamesed configuration. The interbore regions 214, or bore bridges, required cooling, as they are not in direct contact with the fluid in the jacket 216 passages, and experience high heat and pressure loads during engine 200 operation from combustion events.

An open channel 218 or slot is provided in the interbore region 214. The open channel 218 may extend across the interbore region to fluidly connect the cooling jacket passages 216 on opposed sides of the engine 200, e.g. the intake and exhaust sides. In other examples, the open channel 218 may extend across only a portion of the interbore region 214. The open channel 218 intersects the block deck face 208. The channel 218 may extend along an axis 220 that is generally perpendicular to the longitudinal axis 222 of the engine 200. The open channels 218 between different bores 212 may be similar to one another, or may vary in size and shape, e.g., along the length of the engine to control interbore cooling to different bores, or based on changing coolant flow properties at different locations in the jacket 216.

The cylinders 212 may be formed from a different material compared to the block 202, or may be formed from the same material. In one example, the block 202 is formed from aluminum or an aluminum alloy, and the cylinders 212 have liners that are formed from a ferrous material. In another example, both the block 202 and the cylinders 212 and liners are formed from a single material, e.g. aluminum or an aluminum alloy.

The cylinders 212 have an inner wall 224 and an outer wall 226. The outer wall 226 may be a continuous wall forming an outer peripheral boundary of a block of cylinders 212 as shown. In other examples, the outer wall 226 may be outer wall of a single cylinder 212. The outer wall 226 may define or form at least a portion of the cooling channel or passage of the cooling jacket 216 surrounding the cylinders 212.

FIG. 5 illustrates a cylinder head 204 for use with the block 202 of FIG. 4. The head 204 has a head deck face 210 or a surface configured to mate or cooperate with the block deck face 208.

The deck face 210 defines at least one projection 240 extending outwardly therefrom. The projection 240 may be a sleeve or sleeve member as shown. In the example shown, the sleeve is a continuous structure sized and configured to be inserted into the channel 216 of the cooling jacket and surround the cylinders 212. The sleeve 240 is configured to slide into the channel 216 and slide about the outer wall of the cylinders 212 when the head 204 is connected to the block 202 such that the upper portion or end of each cylinder 212 is received by the sleeve 240. The sleeve may only extend across a portion of the channel and/or may extend entirely across the width of the channel. In other examples, the sleeve 240 may be discontinuous, for example, with projection radially spaced about the cylinders 212.

The sleeve is sized to be received by the channel 216 and circumferentially surround the cylinders 212 such that an upper region of each cylinder 212 is nested within each cylindrical section of the sleeve 240. The sleeve 240 is configured to cooperate with the upper portion of the cylinders 212 to provide structural support for the engine. A continuous sleeve 240 provides improved support for the cylinders 212, while a discontinuous sleeve 240 may be easier to manufacture or assemble while still providing sufficient support for the cylinders 212.

The projection or sleeve member 240 has an inner surface configured to mate with an upper region of the outer wall of the cylinders 212 to provide lateral support for cylinders 212 of the engine 200, for example, during high load engine operation to prevent "shake". High specific output boosted engines may be prone to detonation and/or pre-ignition that may create hardware or controls issues. There may be various detonation and/or pre-ignition contributing factors such as, atmospheric conditions, high humidity, altitude, questionable octane or misfueling, and the like. If a detonation event occurs, with it comes a very sharp spike in pressure which creates a force in the combustion chamber formed by the upper cylinder bore walls and cylinder head. These can be extreme forces that induce a shaking effect of the basic structure of the cylinder bore walls. This movement or shake as a result of the extreme forces may also contribute to head lift, which may lead to head gasket/sealing member 206 failure or a multitude of other hardware issues or failures, including those in piston rings, pistons, connecting rods, bearings, crankshaft, cylinder block, cylinder head etc. For an engine without the sleeve member 240, the cylinders 212 extend upwardly in the block towards the deck face 208 and stand unsupported near the deck face due to the channel 216 surrounding the outer circumference of the cylinder 212 group and the open deck face configuration of the block.

The sleeve 240 has an inner first wall 242, and an outer second wall 244. The inner and outer walls 242, 244 are connected by a bottom wall 246. The bottom wall 246 is spaced apart from the deck face 210. The sleeve 240 has an inner perimeter defined by the inner walls 242 that is at least partially defined by the radius of curvature associated with the outer wall of the upper portion of the cylinders 212. The sleeve 240 is illustrated as having a shape defined by a series of adjacent or adjoining circles or cylinders.

The sleeve 240 forms a continuous bridge section 250, bridge region, or bridge that connects opposed sides of the sleeve 240. The bridge section may also be referred to as a tab. The bridge section 250 is extends outwardly from the surface 210 and is sized to be received by the interbore slot or channel 218 to define an interbore cooling passage. The bridge section 250 may form a portion of each of the cylinders of the sleeve 240.

The sealing member 206 may include a single sealing member or multiple sealing members. For the example shown, the sealing member 206 or sealing assembly 206 includes a first sealing member 260. The first sealing member 260 is a head gasket or high performance O-ring that may or may not be nitrogen charged, and defines an aperture 262 that is sized such that the at least one projection or sleeve 240 extends through the aperture 262 when the engine 200 is assembled. The head gasket 260 may also define other various apertures to provide for coolant flow, lubricant flow, head bolts, and the like.

The sealing assembly 206 may also include additional sealing members 264. In one example, these sealing members 264 resemble an O-ring, or a similar sealing structure, and are positioned within the sleeve 240 to surround the chambers of the head 204 and cylinders 212 to help seal the combustion chambers of the engine 200.

FIG. 6 illustrates a cross sectional view of an assembled engine 200. The sleeve 240 or cylinder retaining feature 240 is extending into the channel 216 for the cooling jacket such that the upper region of the cylinders 212 are nested within the sleeve 240 and structurally supported.

The outer wall 226 of the cylinder 212 may have a stepped region 270. The stepped region or step 270 is spaced apart from the block deck face 208. The outer wall 226 of the cylinder 212 may be defined by a first upper section 272 extending between the step 270 and the block deck face, and a second lower section 274. The upper and lower sections 272, 274 may be separated by the step 270. The step 270 may extend circumferentially around the cylinders 212 as shown in FIG. 4. The step 270 may be parallel or substantially parallel with the deck face 208. In other examples, the step 270 may be nonplanar with corresponding structure on the sleeve 240 such that the surfaces mesh or interlock with one another. In other examples, the stepped region 270 may be spaced at varying heights from the deck face, with corresponding differences in sleeve 240 height, based on the location in the engine, for example, with the spacing increasing at opposed ends of the cylinders 212, etc.

The inner wall 242 of the sleeve 240 may be directly adjacent to or abutting the upper section 272 of the outer wall. The bottom wall 246 of the sleeve 240 is directly adjacent to, abutting, or mating with the stepped region 270. The outer wall 244 of the sleeve may be aligned with or substantially flush with the lower section 274 of the outer wall. The lower section 274 of the outer wall and the outer wall 244 of the sleeve cooperate to define a portion of the cooling channel 216 as shown.

The bridge section 250 has side walls that are directly adjacent to or abutting the walls of the slot in the interbore region. The bridge section 250 has an end region or base wall 280 corresponding to the wall 246 of the sleeve 240 that connects the side walls and that is spaced apart from the floor of the slot 218. The bridge section 250 cooperates with the slot 218 to form an interbore cooling passage therebetween.

As can be seen from FIG. 6, the depth of the slot 218 is greater than the height of the bridge section 250 such that the ends of the bridge section 250 and slot 218 are spaced apart from one another to define the interbore cooling passage. The open channels 218 between different cylinders 212 may be similar to one another, or may vary in size and shape, e.g., along the length of the engine to control interbore cooling to different bores, or based on changing coolant flow properties at different locations in the jacket 216.

Note that in one example, the sleeve 240 has a generally uniform height such that a planar wall 246 is parallel with the deck face 210 of the head. In this scenario, the floor of the slot 218 may be offset from the stepped region 270 to provide the interbore cooling passages. In other examples, the base wall 280 of the bridge section 250 may be offset from the base wall 246 of the outer portion of the sleeve 240, with the stepped region 270 and the floor of the interbore slot 218 being co-planar, such that the interbore cooling passage is formed.

As can be seen in FIGS. 4-6, the cylinders 212 are nested within the sleeve 240. In one example, the cylinders 212 and the sleeve 240 may be closely fit with one another in a slight clearance fit, or a location or transition fit between the components. In other examples, the components 212, 240 may have a close sliding fit, or even a slight interference fit. Bosses 290 for jackscrews may be cast or otherwise formed into the block 202 and the head 204 to assist in separating the components after assembly.

The gasket 260 is positioned between the block 202 and the head 204. The gasket 260 has an aperture 262 sized and shaped to closely fit about a periphery or a circumference of the outer wall 244 of the sleeve 240. The aperture 262 is aligned with the sleeve 240 such that the sleeve 240 extends through the aperture 262 when the engine is assembled, and the gasket 260 maintains the seal for the fluids of the engine. The inner sealing member 264 is nested within the inner surface of the sleeve 240 and cooperates with the deck faces 208, 210 to maintain the seal in the combustion chambers.

The engine block 202 and/or head 204 may be formed from aluminum or an aluminum alloy, for example, in a casting process such as a high pressure die casting process. The engine block 202 may be formed using liner inserts for the cylinders 212, which may be formed from another material, such as iron, a ferrous alloy, or the like. The engine block 202 may be formed without cylinder liners such that the bulk cast metal provides the inner wall of the cylinder. The cast metal aluminum may be qualified, machined or otherwise processed to provide the surface finish and smoothness desired for a cylinder wall.

As the block 202 has an open deck configuration, the block 202 does not have structure surrounding the upper region of the cylinders 212. During high engine load, unsupported cylinders in an open deck engine may be subject to "shake". Additionally, the open channel 218 may deform and be subject to distortion due to thermal loads and other engine loads during operation, especially due to the thin walled sections separating the combustion chamber from the open portion of the channel 218. The outward pressure in the combustion chamber of the cylinder 212 during the combustion event may cause unsupported, vertical side walls of the channel to deform or even fold over, resulting in possible engine performance degradation and sealing issues.

The sleeve 240, which includes the bridge section 250, in addition to locating and partially defining the cooling passage in the desired predetermined location in the interbore region, acts as a structural element or support element to prevent cylinder shake during engine operation as well as reduce and prevent bore 212 distortion in the interbore region 214 and in the channel 218. The sleeve 240 generally surrounds the cylinders 212 and prevents movement and shake of the cylinders during engine operation, as the sleeve 240 opposes any movements or forces at the upper region of the cylinders 212, thereby acting to locate and retain the cylinders 212 in place. The bridge section 250, acting under a compression load in the direction of the longitudinal axis 222, prevents cylinder shake along this axis and also prevents the bore bridge 214 and channel 218 walls from deforming.

Figure 7:
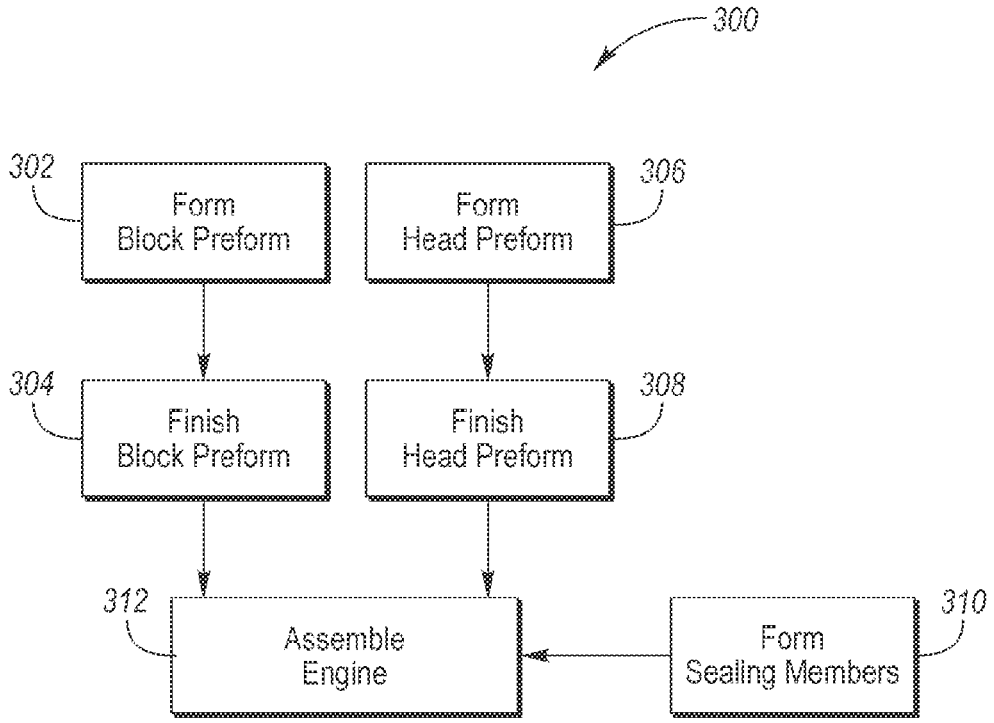
FIG. 7 illustrates a flow chart with a method of forming the engine according to an embodiment.

FIG. 7 illustrates a flow chart for a method 300 of forming and assembling an engine according to FIGS. 4-6. The method 300 may include greater or fewer steps than shown, the steps may be rearranged in another order, and various steps may be performed serially or simultaneously according to various examples of the disclosure.

At step 302, a block preform is formed. The block preform may provide the block 202 as described above. The block may be formed from aluminum or an aluminum alloy, for example in a casting or die casting process. In one example, the block is formed from aluminum or an aluminum alloy in a high pressure die casting process. The casting process may include various dies, slides, lost cores, etc. to form the desired shapes, surfaces, and passages within the block, including the passages for the cooling jacket. The cylinder bores may be provided as a liner insert during the casting process, for example, as a preformed iron or ferrous alloy insert. In another example, the walls of the cylinders are formed from the molten cast metal such that the block is formed without a liner, independent of a cylinder liner, or is linerless. In a high pressure die casting process, the molten metal may be injected into the tool at a pressure of at least 20,000 pounds per square inch (psi). The molten metal may be injected at a pressure greater than or less than 20,000 psi, for example, in the range of 15,000-30,000 psi, and may be based on the metal or metal alloy in use, the shape of the mold cavity, and other considerations. After the molten metal is cooled, a block preform is ejected or removed from the tool. The block preform has at least first and second cylinders separated by an interbore region or bore bridge.

The block preform may be finished at step 304. The finishing steps may include various machining and other post casting processes. For example, the deck face 208 may be milled or otherwise machined to provide a finished surface. The interbore cooling slots 218 may be machined and/or qualified, for example, using a machining process. The stepped region may also be formed or qualified into the cylinder 212 outer walls 226. In one example, the cylinders 212 are machined 360 degrees about the bore defined by the cylinder 212 to provide a mating surface for the sleeve 240.

At step 306, a cylinder head preform is formed. The head preform may provide the head 204 as described above. The head may be formed from aluminum or an aluminum alloy, for example in a casting or die casting process. In one example, the head is formed from aluminum or an aluminum alloy in a high pressure die casting process. The casting process may include various dies, slides, lost cores, etc. to form the desired shapes, surfaces, and passages within the head, including the passages for the cooling jacket. The head may also have various inserts, for example, for the exhaust passages, valves, etc. After the molten metal is cooled, a head preform is ejected or removed from the tool.

The head preform may be finished at step 308. The finishing steps may include various machining and other post casting processes. For example, the deck face 210 may be milled or otherwise machined to provide a finished surface around the sleeve 240. The sleeve 240 may be machined and/or qualified. The sleeve may be formed to extend outwardly from the head deck face. In one example, the sleeve is at least partially formed during the casting process or forming process for the head. In another example, the sleeve may be at least partially formed when the head deck face is machined or otherwise finished. The sleeve may be qualified to a desired shape and size to fit about the cylinders 212 and within the channel 216 and slot 218.

In step 310, sealing members such as a head gasket 260 and inner sealing member 264 may be formed for use with the engine. The gasket is formed with an aperture for the sleeve, with the aperture sized such that the sleeve extends through the aperture. The inner sealing member 264 is formed to nest within the cylindrical sections of the sleeve. The head gasket and inner sealing member may be made from the same material or different materials.

At step 312, the block, the head, and the gasket are assembled to form the engine. The sleeve 240 is inserted into the slots and channel to surround and support the upper region of the cylinders 212 and to form an interbore cooling passage for the bore bridges.

Various embodiments according to the present disclosure have associated non-limiting advantages. For example, the engine block and head may be die cast while retaining strength properties that were previously available only using a sand casting technique. As engine package sizes become smaller for weight reduction, and the increasing demand and requirements for increased fuel economy and reduced emissions continues, engines may be operated at higher operating pressures. In some examples, with a turbocharged or super charged engine, the engine may also operate at increased boost pressures compared to previously turbocharged engines. The interlocking structure of the head and the upper regions of the cylinders provides for structural support as the cylinders are nested and radially supported by the sleeve projecting from the head deck face. As the engine may be provided in an open deck configuration, e.g. as provided from a die cast component, the sleeve projection from the head acts to structurally support the otherwise unsupported upper region of the cylinders, reduce cylinder and interbore distortion at high operating temperatures, and prevent or reduce cylinder shake, movement, or vibration, for example, at high engine load and output.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments.

What is claimed is:

1. An engine comprising:

a cylinder block having first and second cylinders separated by a bore bridge, and a block cooling jacket having a channel intersecting a block deck face to circumferentially surround the first and second cylinders; and a cylinder head having a surface configured to mate with the deck face, the surface having a sleeve protruding therefrom and sized to be received by the channel to circumferentially surround the first and second cylinders.

2. The engine of claim 1 wherein the first and second cylinders define an outer wall defining a portion of the channel, wherein the outer wall has a stepped region spaced apart from the block deck face.

3. The engine of claim 2 wherein the sleeve has a first wall and a second wall connected by a bottom wall, the bottom wall mating with the stepped region.

4. The engine of claim 3 wherein the outer wall of the first and second cylinders has a first section and a second section separated by the stepped region, wherein the first section extends from the block deck face to the stepped region.

5. The engine of claim 4 wherein the first wall of the sleeve is flush with the second section of the outer wall of the first and second cylinders.

6. The engine of claim 4 wherein the second wall of the sleeve abuts the first section of the outer wall of the first and second cylinders.

7. The engine of claim 1 wherein the first and second cylinders are adjoined.

8. The engine of claim 7 wherein the bore bridge defines an interbore slot extending between the first and second cylinders and intersecting the block deck face.

9. The engine of claim 8 wherein the surface of the cylinder head further comprises a bridge section extending outwardly from the surface and connecting opposed sides of the sleeve, the bridge section sized to be received by the interbore slot to define an interbore cooling passage.

10. The engine of claim 9 wherein an end region of the bridge section is spaced apart from a floor of the interbore slot.

11. The engine of claim 1 further comprising a first sealing member positioned between the block deck face and the surface of the cylinder head, the first sealing member defining an aperture sized for the sleeve to extend through.

12. The engine of claim 11 further comprising a second sealing member positioned within the sleeve and between the block deck face and the surface of the cylinder head.

13. An engine comprising:

a cylinder block defining a cooling channel circumferentially surrounding an outer wall of at least one cylinder, the cooling channel intersecting a deck face; and a cylinder head having a surface configured to mate with the deck face, the surface having at least one projection extending outwardly therefrom, the at least one projection received by the channel to cooperate with the outer wall and structurally support the at least one cylinder.

14. The engine of claim 13 wherein the at least one projection comprises a sleeve member having an inner surface configured to mate with an upper region of the outer wall of the at least one cylinder.

15. The engine of claim 14 wherein the at least one cylinder comprises a first cylinder adjoined with a second cylinder via an interbore region; and wherein an inner perimeter of the sleeve member is at least partially defined by a first radius of curvature associated with an outer wall of the first cylinder and a second radius of curvature associated with an outer wall of the second cylinder.

16. The engine of claim 15 wherein the interbore region defines an open channel intersecting the deck face; and wherein the at least one projection further comprises a bridge connecting opposed sides of the sleeve member, the bridge sized to be received by the open channel and define an interbore cooling passage.

17. The engine of claim 13 wherein the cooling channel continuously surrounds the outer wall of the at least one cylinder at the deck face.

18. A method of forming an engine comprising:

forming a block with cast-in passages for a cooling jacket and first and second adjoined cylinders having an outer wall, the cooling jacket circumferentially surrounding the outer wall and intersecting a block deck face;

forming a cylinder head with at least one projection extending outwardly from an intermediate region of a head deck face, the head deck face configured to cooperate with the block deck face; and assembling the cylinder head and the block such that the at least one projection is received within the cooling jacket to surround and cooperate with the outer wall of the first and second cylinders to structurally support the first and second cylinders.

19. The method of claim 18 further comprising forming a step in the outer wall of the first and second cylinders, the step spaced apart from the block deck face; and forming a slot in an interbore region between the first and second cylinders;

wherein the at least one projection is formed with first and second adjoining cylindrical sections, each cylindrical section at least partially surrounding a respective cylinder and extending to the step when the cylinder head is assembled to the block.

20. The method of claim 19 wherein an interbore cooling passage is formed by the slot and an adjoining region of the first and second adjoining cylindrical sections when the cylinder head is assembled to the block.

* * * * *